United States Patent [19]

Arber

[11] Patent Number: 4,708,490

[45] Date of Patent: Nov. 24, 1987

[54] ADVANCE DATE WARNING SYSTEM

[76] Inventor: Amihadar Arber, 4863-A Enfield, Skokie, Ill. 60077

[21] Appl. No.: 945,651

[22] Filed: Dec. 22, 1986

Related U.S. Application Data

[63] Continuation-in-part of Ser. No. 827,750, Feb. 10, 1986, Pat. No. 4,630,934.

[51] Int. Cl.[4] ..... G04B 19/24; G09D 3/00

[52] U.S. Cl. ..... 368/28; 40/107

[58] Field of Search ..... 368/28, 29, 41, 42, 368/43, 72–74, 250; 40/107, 110

[56] References Cited

U.S. PATENT DOCUMENTS 4,225,803 3/1981 Sekine ..... 368/250

4,303,995 12/1981 Aizawa ..... 368/29

*Primary Examiner*—Vit W. Miska

*Attorney, Agent, or Firm*—Silverman, Cass, Singer & Winburn, Ltd.

[57] ABSTRACT

An electronic advanced date warning system including a front surface having means associated with the front surface for lighting selected date warning areas thereon and which include conventional calendar information indicia, circuit means for selectively activating and de-activating the lighting means to light at least one of the selected areas, and control and memory means for programming the circuit means and means to review the programmed dates and number of warning dates associated with each programmed date.

16 Claims, 4 Drawing Figures

50
46
1 2 3 MT PGM
4 5 6 DT SET
7 8 9 YR RVW
T 0 CLR AW CNL
54
EVENT DATE MEMORY
I/O
68
66
60
MULTIPLEXER
44
MICRO PROCESSOR
58
56
CLOCK/ CALENDAR
I/O LINE
62
64
MULTIPLEXER
70
PROGRAM MEMORY
ADD.
DATA
48
DISPLAY DRIVER
52

FIG. 3
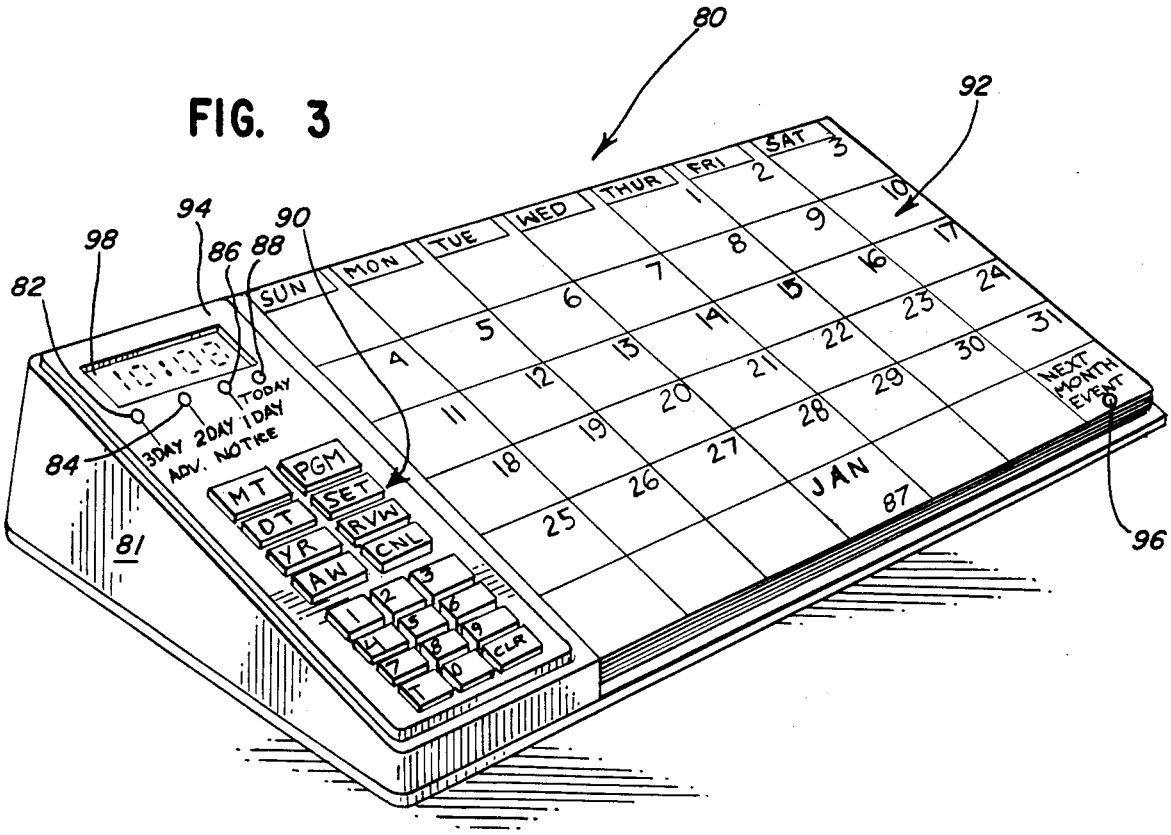
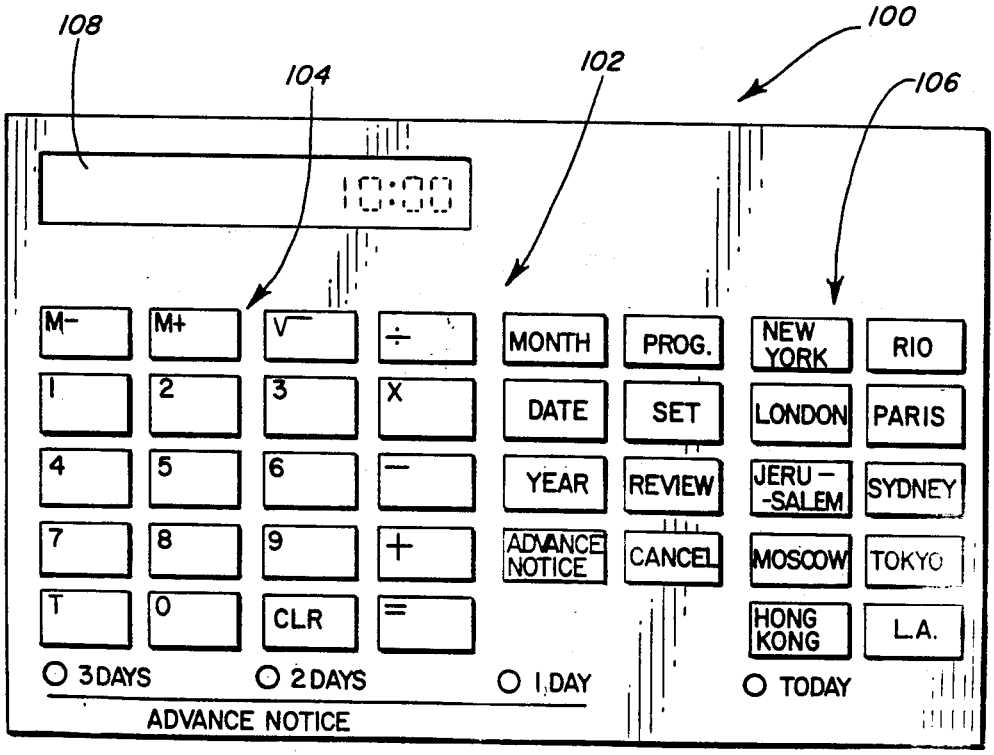
FIG. 4

ADVANCE DATE WARNING SYSTEM

RELATED APPLICATION

This application is a continuation-in-part of parent application U.S. Ser. No. 827,750 filed, Feb. 10, 1986, now U.S. Pat. No. 4,630,934 the disclosure of which is incorporated herein by reference.

BACKGROUND OF THE INVENTION

The present invention relates generally to an electronic advance date warning system which can include a calendar and more particularly to a visual date warning system having attention attracting means associated with specific times before and including the date of interest.

The system will provide advanced warnings for a preselected number of days prior to the selected dates in a distinguishing visual and/or audible way. Personal computers provide means of storing and retrieving events on a daily basis to serve as a date minder, but they lack the most important feature of manual entries made by a common writing instrument without the use of an alpha-numeric keyboard. Consequently, people still prefer the conventional paper calendars which provide ease of entering and an instant visual indication of events to come. This does not provide any special warning of an important date. This invention therefore, in one embodiment, provides the ordinary person with a simple, inexpensive and most important, with a calendar of a familiar format, in which the user can jot down important events and have an advanced warning of the dates approaching. Also the advanced warning system with a calendar of the present invention can be used in the years to come by merely inserting a new 12 sheet calendar refill each year. The advanced date warning system also can be utilized by itself as a dedicated unit or with a caculator or other electronic unit without a calendar.

SUMMARY OF THE INVENTION

The above and other disadvantages of prior art date minders are overcome in accordance with the present invention by providing an electronic advance date warning system which provides a visual and/or an audio warning signal and can include a calculator and a front surface exhibiting conventional calendar information indicia. The system includes means associated with the front surface for lighting selected areas thereon, cirouit means for selectively activating and de-activating the lighting means to light at least one of the selected areas and control and memory for programming the circuit means to provide the advanced date warnings and means for reviewing the programmed dates and the advanced date warnings associated with each date.

BRIEF DESCRIPTION OF THE DRAWINGS

FIG. 3 is a perspective view of one preferred embodiment of the advanced date warning system of the present invention; and FIG. 4 is a front view of a second embodiment of the advanced date warning system of the present invention.

DESCRIPTION OF THE PREFERRED EMBODIMENTS

Figure 1:
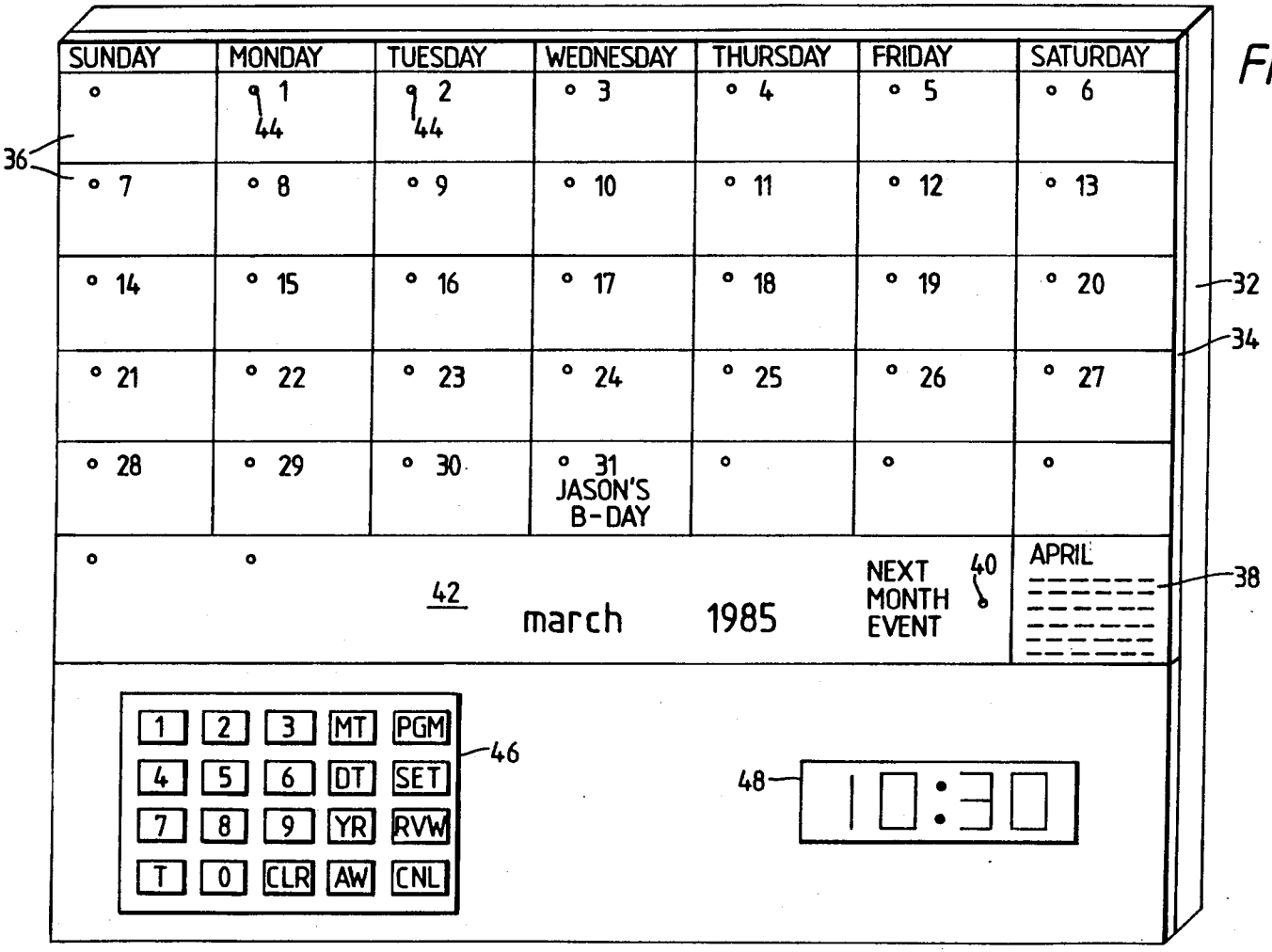
FIG. 1 is a schematic front view of a calendar according to the invention of the parent application.
Figure 2:
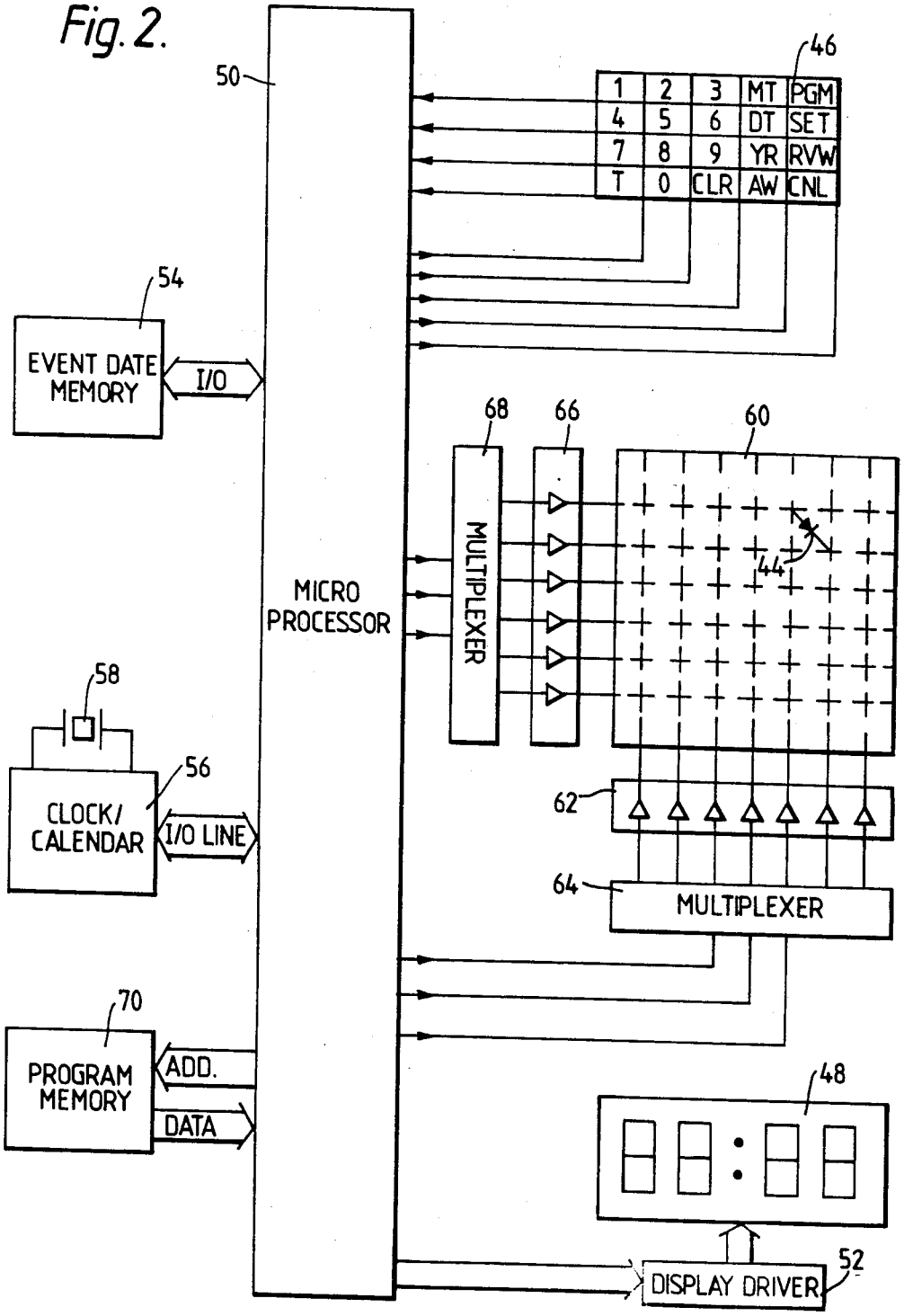
FIG. 2 is an electronic diagram of an arrangement of light emitting elements and their associated circuits and components as used in the calendar of FIG. 1.

FIGS. 1 and 2 are illustrative of embodiments disclosed in the parent application, U.S. Ser. No. 827,750.

There is seen in FIG. 1 a preferred embodiment of the calendar according to the invention of the parent application which includes a base 32 on the front surface of which there is removably affixed a sheet 34 exhibiting standard calendar information indicia. In the embodiment illustrated, the indicia includes either preprinted or jotted-down information relating to the days of the week and the dates of the particular month shown. The dates of the month are depicted within the boundaries of marked areas 36. Advantageously there is also provided an area 38 displaying calendar information with regard to the month following the particularly displayed month. The sheet 34 has a further defined field 42 in which the name of the displayed month and year are depicted and may include further desired information.

The removably interchangeable sheet 34 may be provided without the designation of the days of the week appearing at the top line thereof. Instead, this information may be permanently written on the base 32 or even more advantageously, it may be depicted on a resilient strip of material which can serve as a clamp for affixing of the periodically changeable sheet 34.

As further seen in FIG. 1, each of the areas 36 includes a light emitting element 44, for example, light emitting diodes (LED's) strategically mounted on the base 32 so as to partly protrude through apertures correspondingly provided in the sheet 34, when the latter is correctly affixed on the base 32.

The sheet 34 is preferably made of paper to enable the user to write thereon as is done on any suitable conventional jot-down calendar. Alternatively, the sheet 34 may be made of at least a semi-transparent material, such as plastic, on which surface it is also possible to write with suitable writing instruments.

When the sheet 34 is made of at least semi-transparent material, the areas 36 need not be provided with apertures for allowing the elements 44 to protrude therethrough. The elements may, in this case, be embedded in, or otherwise affixed on, the base 32 and the light eventually emitted by the elements will be noticeable through the transparent sheet placed thereon. Obviously, the intensity of light emitted by each individual LED will be calculated with respect to the size of each individual area so as to assure that the viewer will immediately be able to perceive the specific date and/or the hand written information to which attention is to be drawn.

The base 32 is further provided with a keyboard 46 incorporating keys bearing numerical and alphabetical indicia 0–9, T, CLR, MT, DT, YR, CL, AW, PGM, SET, RVW and CNL, and with an LC display 48. The abbreviations on the keys denote as follows:

MT—enters month
DT—enters date
YR—enters year
AW—advanced warning entry
CLR—clears prior entries
T—enters start-up time
SET—made to set the start-up date and time PGM—program mode to enter future dates into calendar's memory RVW—review mode—to review future date entries CNL—cancel mode—to cancel any date entry Turning now to FIG. 2, there is seen the 4×5 matrix keyboard 46 which is electronically connected to a microprocessor 50. Entries are viewed on the LC display 48 which is connected to the micro-processor 50 through a display driver 52. All event dates which are entered by means of the keyboard are stored in the event date memory chip 54. The micro-processor 50 keeps track of time and dates by constantly referring to clock/calendar unit 56, which unit in turn is controlled for accuracy by a quartz crystal 58. The light emitting elements 44 are connected to a 6×7 light emitting element matrix 60, the latter being connected to, and controlled by, the micro-processor through column drivers 62 and a multiplexer 64, on one side, and through row drivers 66 and a multiplexer 68, on the other side. The program memory is designated by a numeral 70.

The operation of the calendar is as follows: the calendar is first energized by a battery or from a common household wall outlet and then set, by means of the clook/calendar unit 56. This setting will provide an accurate time base and keep track of dates until, e.g., the year 2010, including leap years. If, for example, the start-up date is Mar. 5, 1985, and the time is 10:30 A.M., the key-pressing sequenoe is as follows: SET, 3, MT, SET, 5, DT. SET. 85. YR. SET. 1030, T. This completes the initial start-up of the calendar. At this point the LC display 48 will show the actual time of the day (10:30 A.M.), and pressing the key DT will show on the display the actual date (3-5-85). It should be noted that each and every entry made through the keyboard will be shown on the LC display in order to be able to monitor the entries and prevent errors. In case of an error, the user presses the key designated CLR, this clears the entry and provides for a new, correct entry.

When the user wants to be reminded of an important event, e.g., "Jason's Birthday" that will occur on Mar. 31, 1985, (see FIG. 1) the user will then press keys PGM, 3, Mt, 31, DT, 85, YR. If the user wants an advanced warning of 2 days, he then presses keys 2, AW. The result will be that the light emitting element associated with the selected date will start blinking at a slow rate on March 29, the blinking rate will increase on March 30 and the light emitting element will stay lit on March 31. On April 1, the light emitting element will turn off. Pressing keys 1, AW, immediately, after date-entering procedure will provide a one day advanced warnings. Similarly, pressing the keys 3, AW, will provide three days advanced warning. Pressing just the key AW will provide no advanced warning.

In this respect, it should be noted that the area 38 showing the entire calendar layout of the next month, and/or of the adjacently located attention attracting "NEXT MONTH EVENT" light emitting element 40, whioh is activated to draw attention to an event which will occur in the first days of the forthcoming month, is useful for allowing sufficient advance warning of an upcoming event. The advance warning signalling of the "NEXT MONTH EVENT" light 40 will stop on the first of the new month. Hundreds of upcoming dates can thus be programmed in advance in the above described manner. If the user wants to cancel, e.g., the Mar. 31, 1985 entry, he then presses keys PGM, 3, MT, 31, DT, 85, YR and CNL. Any particular programmed date can be cancelled by merely entering the desired date and then pressing key CNL.

Another unique feature according to the parent application and this invention is the ability to enter dates, which are repeated each year, such as birthdays, anniversaries, memorials, etc. only once. This is accomplished by entering the date, but skipping any reference to year. For example, if a child's birthday falls on October 17, and advanced warning of one day is required, then, the key pressing sequence is: PGM, 10, MT, 17, DT, YR, 1 and AW. This sequence will enter the child's birthday into the calendar's memory in each and every year until 2010.

A still additional feature according to the parent application and this invention is the ability to review the entered dates either in chronological order or according to designated years. As an example, say. the user wants to review entries for 1988, he then presses the keys: RVW and 88. Now, each pressing of the RVW key will cause the LC display 48 to exhibit the 1988 entries, starting chronologically at the beginning of January and ending at the end of December.

It will be readily appreciated that the electronic advanced date warning system described in accordance with the present invention, constitutes a simple and effective way of being reminded of, and of keeping up with, important upcoming events through attention attraction visual and/or audible means, which means, in turn, can be part of a unit with the familiar and conventional jot-down calendar.

In addition to the visual signals which are displayed, an audible signal could also be provided in a manner similar to the visual and selectively audible beeping signals which are common in the widespread digital watches. The audible signal may also be of decreasing time between beeps similar to the visual signals of changing rates.

It is important to note that today's integrated circuit technologies enable all of the circuit elements of the event memory, program memory, clock/calendar, the multiplexers, and the micro-processor to be incorporated into a single chip.

The further improvements of the present invention now will be discussed with reference to FIGS. 3 and 4.

In FIG. 3, a first embodiment of the advanced date warning system embodying the present invention is designated generally by the reference numeral 80. The system or unit includes a base 81 having a plurality of preselected date warning indicia similar to those described with respect to the parent invention.

In one preferred embodiment, four indicia are utilized to provide a three-day advanced date warning. A first indicia 82 is activated to indicate that a programmed date will occur in three days. A second indicia 84 is activated to indicate that a programmed date will occur in two days. A third indicia 86 will be activated to indicate that a programmed date will occur in one or the next day. A fourth indicia 88 will be activated to indicate that the programmed date is that day. More than one or all of the indicia 82, 84, 86 and 88 will be activated if there is more than one programmed date within the selected warning period. For example, on the January 18, with programmed dates of January 19 and January 21, both the indicia 82 and 86 will be activated.

If desired, the indicia could be different colors, or blink at different rates or have different audio signals to provide further differentiation between the warning dates. The indicia can be LED's or can be lamps or other visual indicia. For example, the indicia 82, 84 and 86 can be amber in color and can be continuously activated in sequence on their respective days. The indicia 88 could be red in color and could be intermittently activated to provide a blinking type warning.

A keyboard 90 is provided which is functionally equivalent to the keyboard 46 and the keyboard 90 can be programmed as previously described with respect to the keyboard 46. A conventional paper calendar 92 can be mounted onto a surface 94 of the base 81. The calendar 92 can be written on to provide notes in a conventional manner.

The system 80 also includes a next month event warning indicia or lamp 96 similar in function to the light 40 described above. The indicia 96 provides a warning of a date which will occur in the next month, before the current month's sheet of the calendar 92 is removed. The indicia 96 can be programmed as desired, but one preferred embodiment provides a sense of urgency at a glance.

A preselected number of days before the next month's event, for example three days, the indicia 96 will be activated to blink at a first slow rate. At two days before the programmed date, the indicia will blink at a second faster rate and on the date before the programmed date, the indicia 96 will blink at a second most rapid blinking rate. The user can, with minimal experience tell at a glance how soon the programmed date will occur.

If there is more than one programmed date in the selected warning period, such as three days away and one day away, then the closest warning date takes precedence for the blinking rate of the indicia 96. Also, since the blinking or audio beeps of the indicia 96 can be an annoyance, pressing both the T and CLR keys of the keyboard 90 will cause the blinking and/or audio beeps to cease for that date. The system 80 automatically will restart the blinking and/or audio signals on the next day, if still appropriate. Further, pressing the keys T and CLR again will also reactivate the indicia 96.

Although the system 80 has been illustrated as large unit with the calendar 92, the system 80 also can be a compact dedicated unit with only the functional elements shown on the left side of FIG. 3, excluding the calendar 92. In any case, the system 80 includes a display 98 similar in function to the display 48, which generally displays the time in a conventional manner.

The display 98 is utilized as before with the RVW key to review the programmed entries in chronological order or by designated year. Also, since the system 80 includes one or more preselected warning dates for each programmed date, as previously described, the warning dates associated with each date also can be reviewed.

Also, although the system 80 could incorporate virtually any date through any time period, for convenience the previously discussed period which ended the year of 2010 has been extended to the year of 2048. Therefore, the system 80 has the capability of being a lifetime calendar.

Repeatable periods, such as birthdays, can be repeated every year through 2048, in a manner similar to that discussed before. Further, the system 80 can incorporate other repeatable time periods, such as loan repayments, for example for an automobile. The starting date is entered into the system 80 by month and year along with the number of payments, for example thirty-six months. The date then is automatically programmed for the day of each succeeding month for 36 months.

A second embodiment of the system is designated generally by the reference numeral 100 in FIG. 4. The system 100 again includes a keyboard 102, with similar keys and a substantially identical programming function to that described with respect to the keyboards 46 and 90. The function keys can be larger on the system unit 100 and therefore the descriptions do not need to be abbreviated.

In addition, the keyboard 102 provides a calculator unit 104, which is illustrated with the basic conventional calculator keys, but could, however, include any type of calculator/programmer or other electronic unit desired. Additionally, the keyboard 102 includes a time selection section 106 which allows the unit 100 to display the looal time associated with the cities selected on the section keyboard 106 on a conventional clock display 108. In other respects, the unit 100 functions the same as the unit 80.

Modifications and variations of the present invention are possible in light of the above teachings. The system 80 and 100 are illustrated as desk units and such is the preferable form, however, the systems 80 and 100 also could be part of other desk or wall-type units and the particular layout and structure is not critical to the described incention. It is therefore to be understood that within the scope of the appended claims, the invention may be practiced otherwise than as specifically described.

What is claimed and desired to be secured by Letters Patent of the United States is:

1. An electronic advanced date warning system, comprising:

a base having a front surface;

means associated with said front surface for lighting selected areas thereon, said areas including a first warning area to be activated when a programmed date is reached and at least one advanced warning area to be activated in advance of said programmed date;

circuit means for selectively activating and deactivating said lighting means to light at least one of said selected areas; and control and memory means for programming said circuit means.

2. The system as defined in claim 1, wherein said front surface includes an interchangeable paper sheet mounted thereon, divided into defined areas bearing calendar information indicia separate from said warning areas.

3. The system as defined in claim 2, wherein said lighting areas include a warning area to be activated when a programmed date is to occur within a selected number of days in the next calendar month.

4. The system as defined in claim 3, including means for activating said next month warning area in a manner which can be sensed at a glance by periodically varying the activation of said areas at different rates for each different warning day in advance of said programmed date.

5. The system as defined in claim 4, wherein the closest one of the programmed dates within said selected number of days in the next month determines said area periodic activation rate.

6. The system as defined in claim 4, including means for deactivating said warning area when desired.

7. The system as defined in claim 1, wherein said lighting means associated with the front surface are LED's arranged on said base.

8. The system as defined in claim 1, wherein said control means for programming said circuit means includes a keyboard having a plurality of individual keys, each bearing indicia selected from the group comprising the numerals zero to nine and indicia denoting the functions of entering dates and advanced warning dates, and the functions for setting, clearing and cancelling date entries.

9. The system as defined in claim 1, further comprising a display for exhibiting information including programmed dates and associated date warning information entered into said memory means.

10. The system as defined in claim 1, wherein said circuit means include means for reviewing date warning information associated with programmed dates entered into said memory means.

11. The system as defined in claim 1, wherein said lighting areas include a plurality of advance warning areas with at least a first area indicating said programmed date is one day away and a second area indicating said programmed date is two days away.

12. The system as defined in claim 11, including at least a third advanced warning area indicating said programmed date is three days away.

13. The system as defined in claim 11, wherein more than one of said areas is activated when more than one programmed date is within two days of one another.

14. The system as defined in claim 1, including means for programming in a date repeatable on a periodic basis each month or year.

15. The system as defined in claim 13, wherein said date is repeatable for a selected number of months or years.

16. The system as defined in claim 1, wherein said first warning area is activated in a periodic manner to provide a blinking warning of the programmed date.

* * * * *